US005131170A

United States Patent [19]

Rilke

[11] Patent Number: 5,131,170

[45] Date of Patent: Jul. 21, 1992

[54] FREEZE-DRYING APPARATUS

[75] Inventor: Rainer Rilke, Köln, Fed. Rep. of Germany

[73] Assignee: Finn-Aqua Santasalo-Sohlberg GmbH, Hürth, Fed. Rep. of Germany

[21] Appl. No.: 659,586

[22] Filed: Feb. 22, 1991

[30] Foreign Application Priority Data

Feb. 26, 1990 [DE] Fed. Rep. of Germany ..... 4006015

[51] Int. Cl.[5] ..... F26B 13/30

[52] U.S. Cl. ..... 34/92; 137/625.31; 34/15; 34/5

[58] Field of Search ..... 34/92, 69, 15, 17, 5; 137/625.31, 625.32; 251/65, 129.11

[56] References Cited

U.S. PATENT DOCUMENTS

| | | | |
|---|---|---|---|
| 3,077,036 | 2/1963 | Neumann | 34/92 |
| 3,271,874 | 9/1966 | Oppenheimer | 34/92 |
| 3,513,559 | 5/1970 | Eilenberg | 34/92 |
| 3,769,717 | 11/1973 | Lorentzen et al. | 34/92 |
| 4,395,019 | 7/1983 | Searles | 251/357 |
| 4,510,106 | 4/1985 | Hirsch | 34/92 |
| 4,516,606 | 5/1985 | Worley | 137/625.31 |
| 4,776,104 | 10/1988 | Kuoyama | 34/92 |

FOREIGN PATENT DOCUMENTS

| | | |
|---|---|---|
| 1160290 | 12/1963 | Fed. Rep. of Germany . |
| 1185544 | 1/1965 | Fed. Rep. of Germany . |
| 1118352 | 7/1968 | United Kingdom . |

*Primary Examiner*—Henry A. Bennet
*Assistant Examiner*—Denise L. F. Gromada
*Attorney, Agent, or Firm*—Felfe & Lynch

[57] ABSTRACT

An intermediate support plate (4) is located between the freeze-drying chamber and the condensation chamber and is equipped with a closeable port; in order to be able to properly adjust the orifice of the port it is formed by two discs (15, 18) that can be rotated relative to each other around a central axis of rotation. Each disc carries circular holes (21, 22) at a radial distance away from the axis of rotation and these holes are so located and designed that by rotating the discs a position of complete axial overlap, one of zero axial overlap and any position in between can be achieved.

7 Claims, 1 Drawing Sheet

FREEZE-DRYING APPARATUS

BACKGROUND OF THE INVENTION

The invention relates to a freeze-drying apparatus with a freeze-drying chamber, a condensation chamber and an intermediate support plate which is located between the freeze-drying chamber and the condensation chamber and is equipped with a closeable port.

A freeze-drying apparatus of the, type indicated here is known from the U.S. Pat. No. 3,077,036. The freeze-drying chamber of this apparatus has shelves where the product is placed during the drying process. For achieving the required vacuum and to precipitate the water vapor created during the drying process, a condenser with a valve connection to the evacuation equipment is provided. A check valve is installed between the freeze-drying chamber and the condensation chamber. Check valves are disadvantageous in that they cannot be easily used for flow regulation, i.e. an orifice with a defined cross-section cannot be exactly achieved. Furthermore, an incompletely opened check valve influences the direction of flow of the water vapor between the freeze-drying chamber and condensation chamber such that a one-sided exposure of the condenser results. This entails an unequal loading of the condenser.

The objective of the present invention is to create a freeze-drying apparatus of the type specified above which does not exhibit the described detriments.

SUMMARY OF THE INVENTION

In accordance with the present invention, this objective is met by designing the opening port in the form of two discs that can be rotated relative to each other around a central axis of rotation. Each disc carries circular holes at a radial distance away from the axis of rotation and these holes are so shaped and located that by rotating the discs a position of complete axial overlap, one of zero axial overlap and any position in between can be achieved.

The use of this type of a valve between the freeze-drying chamber and condensation chamber has the advantage of allowing for a relatively simple adjustment of the size of the port orifice. Furthermore, there is an unhindered water vapor flow through the port orifice to the condensor such that no change in direction occurs and the condensor is always exposed from all sides.

It is expedient for each of the discs to contain a number of holes (for instance four) which are arranged on a circle that is concentric to the axis of rotation of the discs. In this way, a particularly uniform flow through the orifice in the intermediate support plate is achieved.

DETAILED DESCRIPTION OF THE PREPARED EMBODIMENT

Figure 1:
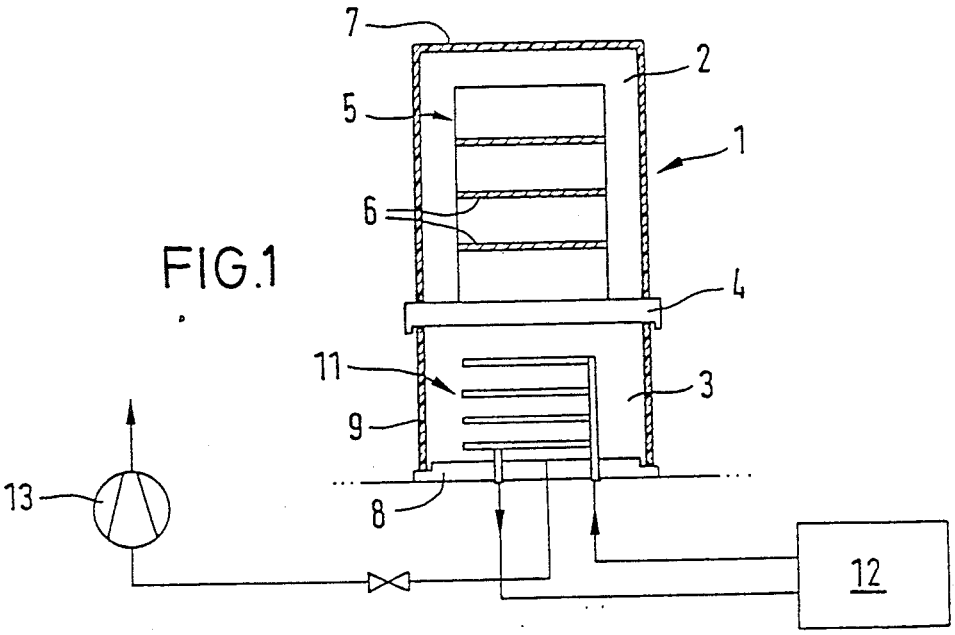
FIG. 1 shows a cross-section of a freeze-drying apparatus designed in accordance with the present invention

The freeze-drying apparatus 1 shown in FIG. 1 has a freeze-drying chamber 2 and a condensation chamber 3. Both are of cylindrical design, one being positioned on top of the other. The intermediate support plate 4 is both the cover of the condensation chamber 3 and the base plate of the freeze-drying chamber 2. The intermediate support plate 4 is equipped with closeable openings which allow a combination or separation of chambers 2 and 3; these closures are not shown in FIG. 1.

Located within the freeze-drying chamber 2 is a rack 5 with shelves 6. The chamber wall 7 is a cylindrical hood supported on the intermediate support plate 4 and preferably made from acrylic glass. The condensation chamber 3 is made up of the intermediate support plate 4, of the base plate 8 and of the cylindrical body 9, the latter of which is also preferably made from acrylic glass. The condenser 11 is located inside the condensation chamber 3. The base plate 8 is positioned on top of a housing (not shown in FIG. 1) which, as schematically shown, contains the condenser 11 and the vacuum pump 13 for evacuating the condensation chamber 3.

Figure 2:
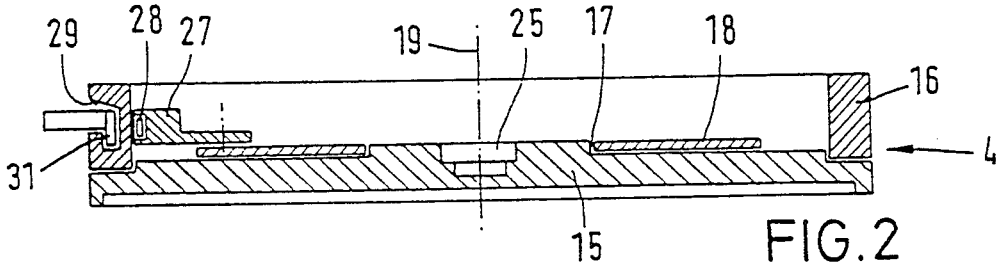
FIG. 2 shows a cross-section through the intermediate support plate and FIG. 3 shows a plan view of the intermediate support plate.
Figure 3:
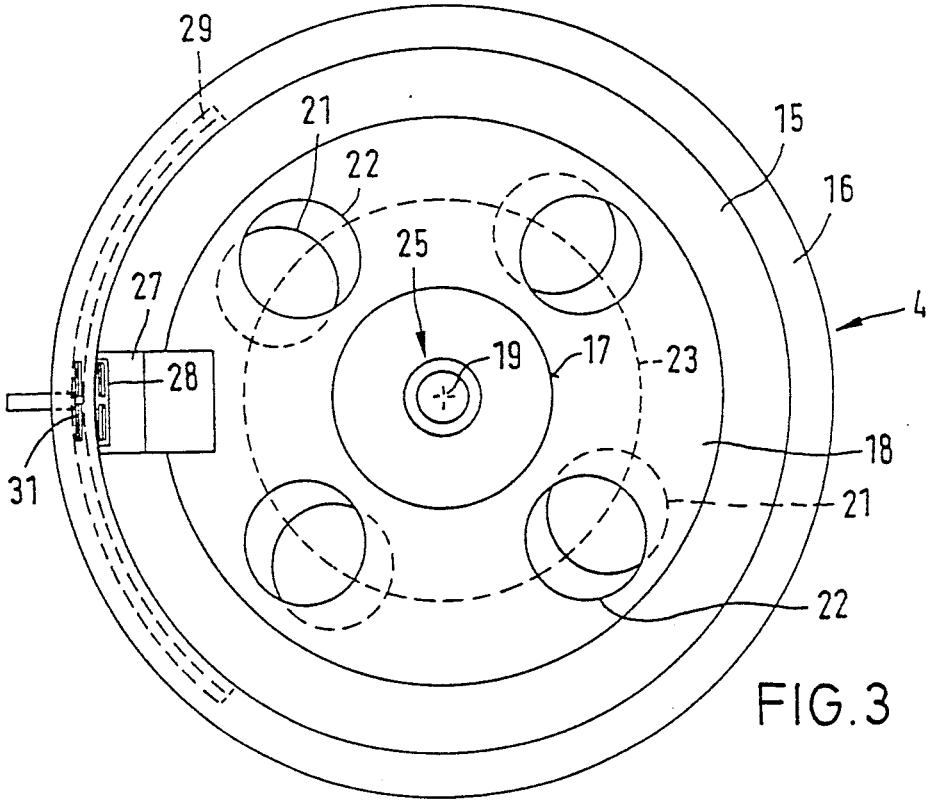

On the basis of FIGS. 2 and 3 it is seen that the intermediate support plate 4 consists of a ring 16 mounted in a vacuum leak tight fashion on a circular plate 15 of an equal outside diameter. The center of the plate 15 is characterized by a concentric rim 17 which is the hub of a circular ring disc 18. The disc 18 can, thus, be rotated around the central axis 19.

Four circular openings 21 and 22 are machined into both the plate 15 and the disc 18 (FIG. 3). These openings 21, 22 are arranged to lie on a circle 23 (shown as a dashed line) that is concentric to the axis 19. The diameter of the openings 21, 22 is designed to be smaller than their distance on the circle 23 which make it possible to achieve a valve function from a rotation of the disc 18. The size of the port orifice formed by the openings 21, 22 is continuously variable between the completely open position (concentric position of the openings 21, 22) and completely closed position (non-coinciding positions of the openings 21, 22).

The fact that the openings 21, 22 are located on a concentric circle away from the axis makes it possible to mount a thrust bearing (not shown) in the center of the plate 15. The indentation 25 is meant to house this bearing. With plate 15 in a horizontal position, this thrust bearing can be used to support rotational equipment on the plate 15. Rotational equipment is required if the product inside the freeze-drying chamber 2 should be freeze dried under the effects of centrifugal forces.

In order to be able to rotate disc 18 without necessitating a penetration to the outside, magnetic force is used. A support 27 for a magnet 28 is mounted to the disc 18. A guide groove 29 is machined into a circumferential section outside of the ring 16 which is meant to guide the metallic or magnetic counterpart 31 of the magnet 28. A rotation of the disc 18 is achieved by moving the counterpart 31 in the guide groove 29.

I claim:

1. Freeze drying apparatus comprising a freeze drying chamber, a condensation chamber, a support plate in the form of a common wall separating said freeze drying chamber from said condensation chamber, said plate having at least one port therein, a disc mounted against said plate and having an axis of rotation so that said disc can be rotated relative to said plate, said disc having a hole which can be aligned with a respective said at least one port by rotation about said axis, and magnetic means for transmitting forces to effect rotation of said disc relative to said plate.

2. Apparatus as in claim 1 wherein said plate has a plurality of ports and holes so located and spaced that complete overlap, zero overlap, and any position therebetween are possible.

3. Apparatus as in claim 1 wherein said ports in said plate are circular ports of identical size, and said holes in said disc are circular holes of identical size.

4. Apparatus as in claim 1 wherein said plate has an upstanding circular rim concentric to said axis of rotation, said rim serving as a hub for said disc.

5. Apparatus as in claim 1 wherein said plate has an indentation on said axis of rotation for supporting an axial thrust bearing.

6. Apparatus as in claim 1 wherein said magnetic means comprises a magnet supported on said disc.

7. Apparatus as in claim 6 further comprising a ring fixed to said plate concentrically outside said disc, said ring having groove means therein, and magnetic counterpart means slidably mounted in said groove for cooperating with said magnetic to rotate said disc.

* * * * *